United States Patent [19]

Hilliard

[11] Patent Number: 4,744,171

[45] Date of Patent: May 17, 1988

[54] HANGING POT SUSPENSION SYSTEM

[76] Inventor: William G. Hilliard, Box 2, N.C. 61, Whitsett, N.C. 27377

[21] Appl. No.: 832,397

[22] Filed: Feb. 24, 1986

[51] Int. Cl.[4] ..... A01G 9/02

[52] U.S. Cl. ..... 47/67; 47/66

[58] Field of Search ..... 47/67, 66; 248/318, 248/317; 220/95, 94 R, 94 B; 272/85

[56] References Cited

U.S. PATENT DOCUMENTS

| | | | |
|---|---|---|---|
| 3,025,997 | 3/1962 | Matusky et al. | 220/95 |
| 4,442,629 | 4/1984 | Anderson | 47/67 |
| 4,592,166 | 6/1986 | Tendrup et al. | 47/67 |

FOREIGN PATENT DOCUMENTS

| | | | |
|---|---|---|---|
| 8502525 | 6/1985 | PCT Int'l Appl. | 47/67 |

*Primary Examiner*—Robert A. Hafer
*Assistant Examiner*—Bradley M. Lewis
*Attorney, Agent, or Firm*—Charles R. Rhodes; Judith E. Garmon

[57] ABSTRACT

A wire hanger assembly includes a hook member with at least three wire members depending therefrom, which wire members are specially designed for quick attachment to and release from a compatibly designed container. Each wire includes an enlarged protuberant end portion and the rim of the hanging container includes a plurality of substantially T-shaped slots therein. Each protuberance is inserted through the cross portion of one of the T-slots, and then the wire portion above the protuberance is slipped back to a position where the protuberance is seated in a cavity from which it cannot inadvertently slip.

9 Claims, 2 Drawing Sheets

HANGING POT SUSPENSION SYSTEM

BACKGROUND AND SUMMARY OF THE PRESENT INVENTION

The present invention relates to hanging pots of a type generally used for plants and flowers. Such pots are commonly formed of a plastic material and have an annular flange or rim around the top thereof designed to accept some type of hanger device. The most popular of these pots is used in conjunction with a wire suspension member of the type including three or four wire strands connected together at the top by a hook. Each strand is inserted into one of a plurality of apertures in the rim of the pot and the end of the wire is twisted around the rim and itself to secure the wire.

Many problems arise with these conventional wire hangers; problems related to attachment and removal from the pot, and problems with adjusting the hangers so that the pots hang level. To ensure that the pots are level, each of the wire strands must be inserted through the rim aperture the same distance. Then, as the wire is twisted up around the rim of the pot and back around itself, the length of the strands must be maintained consistently around the pot. While this can be accomplished, it is difficult and time consuming. Therefore, in large scale nurseries the attachment of the hangers to the pots becomes an expensive procedure because of the time that personnel must devote to the task.

Further problems occur at the consumer level. If the pots are not hanging level, the wires can be difficult for the consumer to untwist and reposition. Or, the wires can be difficult to remove completely if the consumer wants to put the pot into a cachepot or basket.

Other types of hangers are disclosed in U.S. Pat. Nos. 4,440,371; 4,138,803; and 3,943,661. Generally, these patents are directed to container hangers which are made out of plastic and which have a variety of means for attaching the hanger to the container. However, it has been found that plastic hangers are subject to problems equal to or greater than those of wire hangers. Although the ends of the plastic hangers can be formed into a variety of shapes of hooks and other means for attachment to the pot rim, the plastic hangers are quite frequently subject to stretching and/or breaking under the weight of a potted plant. Additionally, if the plastic strands or plastic wires are not properly moded or extruded, the enlarged tips (such as in U.S. Pat. No. 3,943,661) snap off before ever being used or at the time they are attached to heavy pots.

It was to overcoming these disadvantages and to the provision of an improved and unique metallic wire hanger that the present inventor turned. Although metallic wire cannot be as easily shaped and molded as plastic products, metallic wire is far stronger and has a far longer life than comparable plastic hangers. The present hanger is comprised essentially of a metallic wire hanger having a hook suspension member and at least three depending connecting wires, and a container having a rim with a uniquely configured annular flange around the top thereof.

Each of the connecting wires includes, on the tip thereof, an enlarged member or "protuberance" which is readily inserted into complementarily-shaped slots in the annular flange or rim of the container and snapped into a retainer means or cavity beneath the rim, thus connecting the hanger to the container.

In the preferred embodiment the protuberance is formed by curling the end of the wire around to form an eyelet-shaped enlargement on the end of the strand. A plurality of identically shaped T-slots are equidistantly spaced circumferentially around the annular rim of the container.

An eyelet retainer means in the form of a cavity is provided beneath the rim and the leg portion of the T-slot to receive the eyelet and securely retain it in position within the leg portion of the T-slot. The cavity is formed by a block-like projection or boss which is molded into the under portion of the annular rim, beneath the leg portion of the T-slot. The leg portion of the slot extends through the wall of the block-like boss into communication with the aforesaid cavity which receives the eyelet. In the cavity there is also formed a nodule or bead molded onto a sidewall onto which the eyelet is snapped. The cavity is of such size and shape as to functionally engage the eyelet and hold it in place. The bead further ensures inadvertent dislodgement of the eyelet or protuberance.

Other forms of enlargements or protuberances might be formed on the end of the wires and will be discussed in detail below. For example, it is possible that the boss and cavity configuration could be eliminated and the protuberance merely held in place by virture of the protuberance being wider than the T-shaped slot in the rim, however, such construction would not offer all the advantages of the illustrated embodiment. It can be seen that the present invention achieves the objective of providing a metallic wire hanger for plant containers; which hanger overcomes the problems and disadvantages of prior designs. Further advantages and objectives wlll become apparent to those skilled in the art as the following detailed description is studied in conjunction with the following drawings.

DETAILED DESCRIPTION OF A PREFERRED EMBODIMENT

Figure 2:
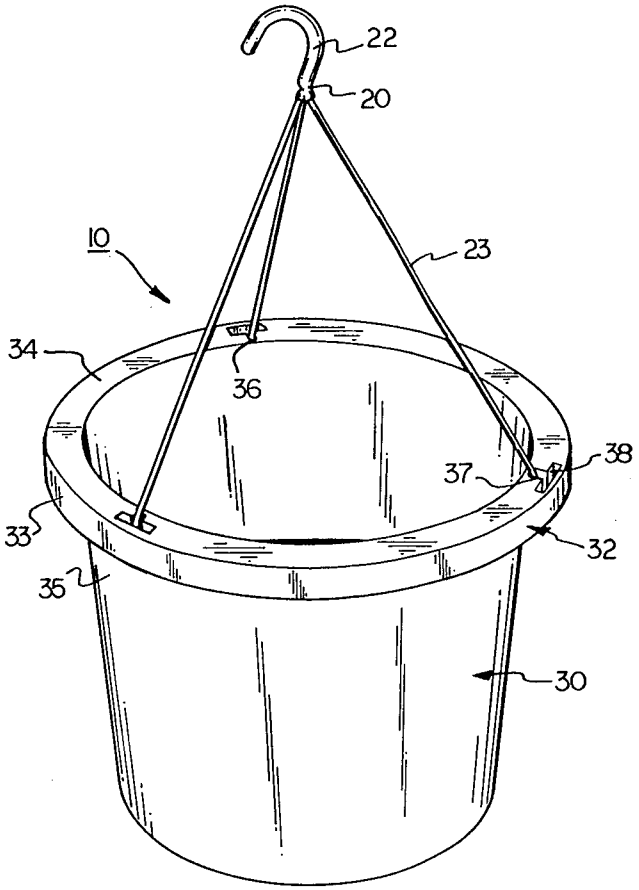
FIG. 2 is a perspective view of the container hanger according to a preferred embodiment.
Figure 1:
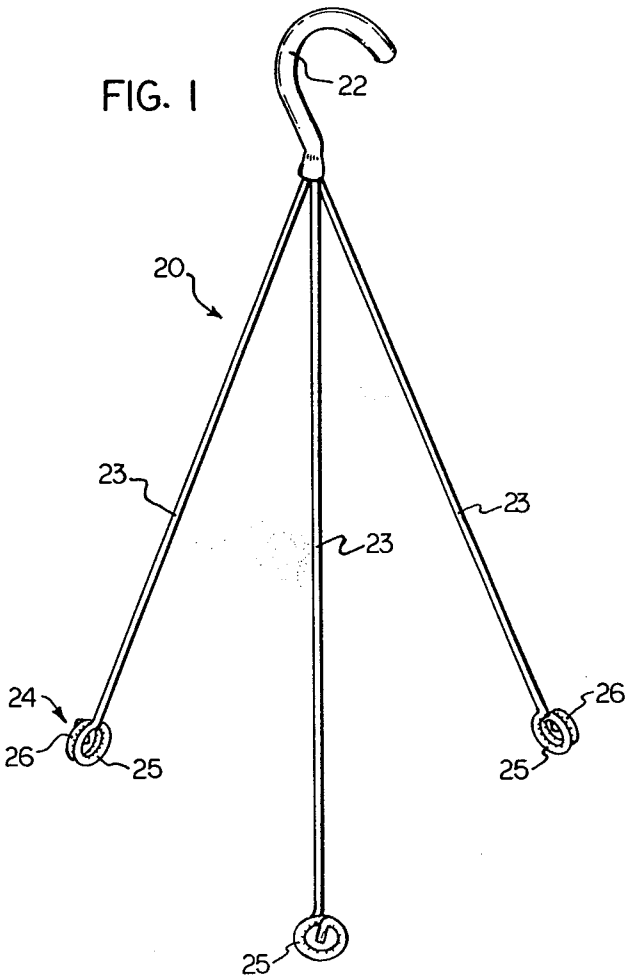
FIG. 1 is a perspective view of the wire hanger designed for use in conjunction with the present invention.

Looking first at FIGS. 1 and 2 the improved plant container 10 is comprised of a hanger 20 and complementary container 30. The hanger 20 is formed of a metallic wire for strength and durability. The selected wire should be of a non-corrosive nature.

The hanger 20 is comprised of a hook-type suspension member 22, and at least three depending wire stand connectors 23 which connect the hook to the container 30. On the terminal ends of the strands 23 a protuberance or eyelet 24 is formed to releasably attach the strand to the container. Preferably, and as illustrated the protuberances 24 are all so formed so that the plane of the protuberance, in the relaxed position, is perpendicular to a radius passing outwardly from the center of the hanger 20. This prevents any tendency for the hanger to be skewed or under stress when assembled.

Protuberances 24 are preferably formed by curving the end of each strand around into an eyelet-shaped formation. While the wire end could be wrapped only one turn, thus forming a single loop eyelet, it is preferred to wrap the wire at least twice to form an eyelet comprised of a concentrically arranged pair of wire formations 25 and 26. Such a design actually reinforces the protuberance 24 and lessens the chance of distortion under the weight of the filled container. For further strengthening and reinforcement if desired, the wire may be concentrically wrapped as many as four or more turns, or the eyelet wires 25 and 26 may be soldered together to form a single, thickened eyelet wall that cannot be unwrapped. Additionally, multiple wraps increase the surface area and thus increase the support surface of the eyelet.

The container 30 is essentially for the most part, a conventionally molded plastic pot. There is an annular rim or flange 32 which surrounds the upper edge of the pot. The rim 32 is of an inverted U-shape having an outer side wall 33, a top wall 34, and an inner side wall 35 formed by the sidewall of the pot. The top wall 34, which is actually a laterally extending flange that supports and strengthens the upper edge of the pot, includes in the embodiment shown, a plurality of T-shaped slots 36 equidistantly spaced circumferentially therearound (120° apart in the case of the three wire embodiment). Each T-shaped slot includes a cross-arm 38 and the leg portion 37 of the T-slot is substantially perpendicular to the side wall 35 of the pot, and the cross portion 38 is substantially perpendicular to the leg portion 37. Leg portion 37 is wider than the diameter of wire 23, but narrower than the diameter of protuberance 24.

Figure 5:
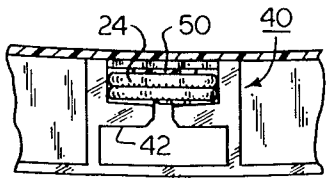
FIG. 5 is a bottom of a position of the rim illustrating the cavity and slot shape.
Figure 6:
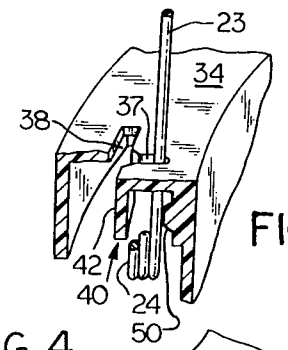
FIG. 6 is a sectional perspective view of the retaining cavity.
Figure 4:
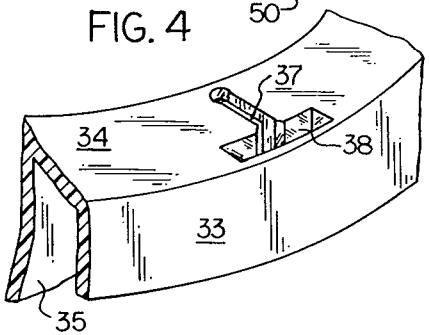
FIG. 4 is an enlargement of a portion of the rim of FIGS. 1 and 3.
Figure 3:
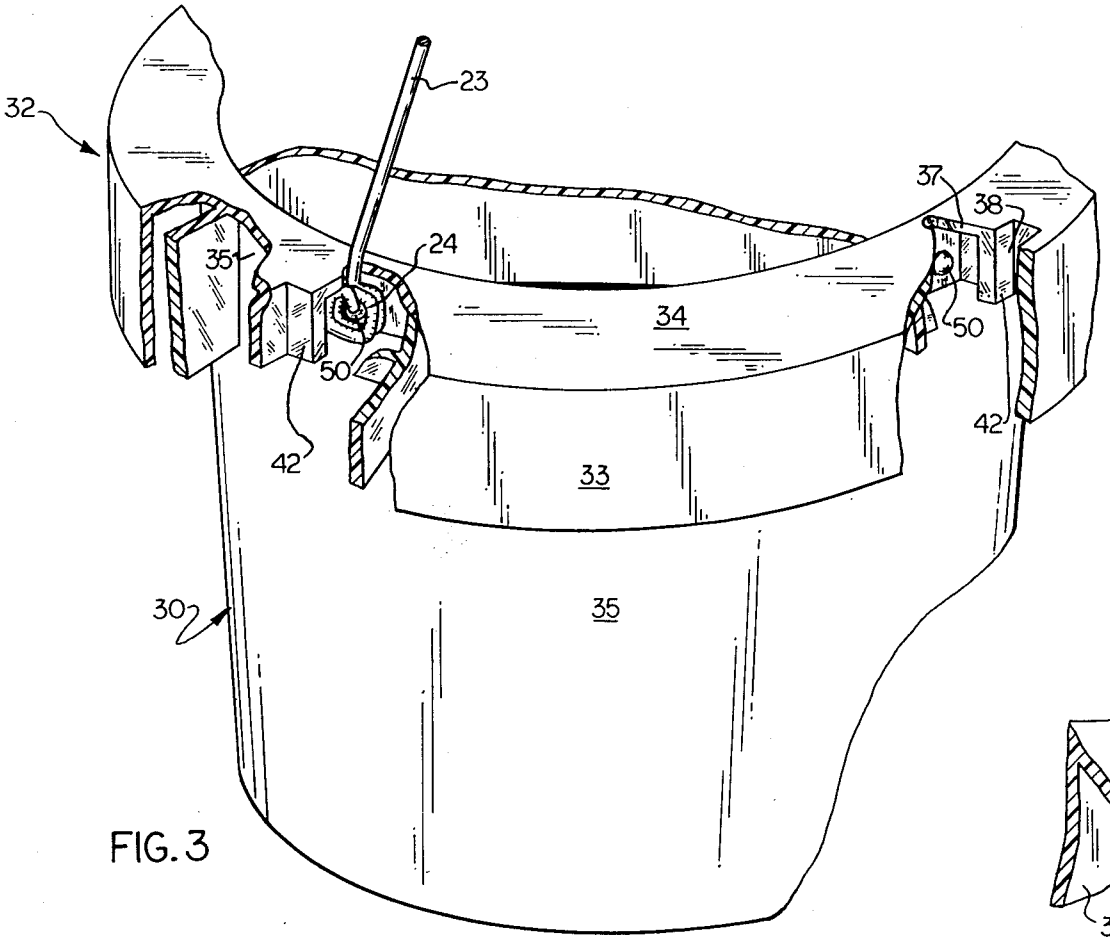
FIG. 3 is an enlarged perspective view of the container rim, with parts broken away.

In the preferred embodiment shown further in FIGS. 3, 4, and 6, a reinforcing plate or boss 40 is molded beneath the rim 32 and behind the rim 33 of the pot, in communication with and beneath slot 36. The leg portion 37 of slot 36 extends through the wall 42 of the boss 40 and therethrough to a cavity 42 in the center of the boss. The cavity 42 is the approximate depth and width of the protuberant member 24 for the purpose of frictionally receiving protuberance 24 therein. A bead 50 is molded into the sidewall 35 and extends into the cavity 42 as best illustrated in FIGS. 5 and 6 to serve as a locking means. This locking feature reduces the likelihood that the protuberance 24 will become inadvertently dislodged. The boss 40 is open at the bottom so that the wire may pass through the leg of the T-slot only when the protuberance is below the underside of the boss 40. The leg of the T-slot is just wide enough to accomodate the wire 23 and is slightly widened at the entrance to facilitate assembly. While to boss 40, as illustrated, is shaped to receive the eyelet-shaped protuberance 24, it is of course anticipated that the shape of the inner cutout 42 could be modified to receive a variety of shapes of protuberant members.

FIG. 6 best illustrates the bead or nodule 50 that extends into the open center of the eyelet to further lock the eyelet in place and its relationship with protuberance 24. The bead 50 can be a variety of shapes and sizes as necessary to accomodate a given protuberance and/or to vary the degree of protuberance retention.

To join the hanger to the container, the eyelet or protuberance 24 is inserted through the cross-arm 38 of slot 36 and downward to a position below the lower edge of wall 42. The wire strand 23 just above the protuberance is then pushed radially inwardly through the leg portion 37 of the slot 36 toward the wall 35 of the pot. (See FIGS. 3 and 6) The leg portion 37 of the T-slot is just wide enough to accomodate the diameter of the wire strands 23, and the cross portion 38 is just long and wide enough to allow the insertion of the protuberance 24 therethrough. Further, because of the manner in which the hanger 20 is fabricated, the protuberance 24 is automatically aligned with the cross-arm 38 of the T-slot 36. So aligned, there is no need to twist or otherwise manipulate the wire 23 or protuberance 24 during installation. The wire 23 is then pulled upwardly bringing the protuberance 24 into seated arrangement in cavity 42 with the eyelet 24 snapped onto bead 50.

While other and further modifications might be considered and made to the above described hanger, it is believed such modifications will remain within the scope of the claims below:

I claim:

1. A hanger for plant and flower hanging containers of the type having a basket or pot with an annular inverted, slotted, U-shaped rim around the circumference of the top wall portion which defines an annular recess underlying said rim, said hanger comprising:

(a) a hook means having at least three elongated metallic wire members depending therefrom for connecting said hook means to the U-shaped rim of said container;

(b) said wire members extending downwardly and outwardly from said hook means and terminating in free ends spaced equidistantly apart;

(c) a protuberance integrally preformed from the metallic wire material itself on the free end of each of said metallic wire members prior to insertion into a basket or pot;

(d) each of said protuberances comprising an eyelet formed by bending the free end of wire around in at least one loop, said loop being so shaped as to form a plane, said plane formed by said loop, with the corresponding wire member in the relaxed position, lies perpendicular to an imaginary line passing from an imaginary point centrally located between said free ends of said hanger outwardly through said protuberance;

(e) whereby said protuberances are more easily inserted through a selected one of said slots and releasably retained therein without torsional stress.

2. A hanging pot apparatus including a hanger assembly from which is suspended a container of the type having an annular inverted U-shaped rim around the circumference of the top wall portion which defines an annular recess underlying said rim; said hanging pot suspension system comprising:

(a) said hanger assembly including a suspension means having at least three elongated metallic wire members depending therefrom for connecting said suspension means to said container;

(b) said container rim including at least three equally spaced, T-shaped slots spaced around the upper periphery thereof for receiving said wire members therethrough, each of said T-shaped slots including a generally radially extending leg and a cross arm extending generally perpendicular to said leg;

(c) a protuberance formed integrally from the metallic wire material itself on the free end of each of said metallic wire members opposite said suspension means, each of said protuberances comprising an eyelet formed by bending the free end of said wire around in at least one loop;

(d) said T-shaped slots being formed in a shape complementary to the shape of said eyelet, whereby each of said eyelets are inserted through the cross arm of a selected one of said slots and releasably retained under said rim inwardly of said cross arm;

whereby said hanger assembly is quickly and releasably connected to said container for suspension purposes.

3. The hanging pot apparatus according to claim 2 wherein the plane formed by said eyelet is aligned with said cross-arm of said T-slot so that no manipulation or twisting of said protuberance is necessary when installing.

4. A hanging pot apparatus according to claim 2 and further including a reinforcing member positioned beneath said rim in said annular recess at a point underlying each of said T-shaped slots; said reinforcing member comprising a boss having side and rear walls descending from said rim and an open bottom forming a cavity therein defined by said side walls said rear wall, and the adjacent wall of said container, the leg of said T-shaped slot extending through said rear wall as well as through said rim, whereby said protuberance is inserted through said cross-arm and the wire is then moved radially inwardly through said leg portion, whereupon said protuberance is lifted into seated arrangement in said cavity.

5. A hanging pot apparatus according to claim 4 wherein said cavity further includes a bead projecting from the wall of said container into said cavity engaging the open center of said eyelet when said eyelet is seated in said boss.

6. A hanging pot apparatus according to claim 4 wherein the size and shape of said cavity are substantially the same as the corresponding size and shape of the protuberance whereby a friction fit of said protuberance in said cavity is effected.

7. The hanging pot apparatus according to claim 2 wherein the cross arms of said T-shaped slots are greater in dimension than the diameter of said eyelet and said leg is formed by edges defining a slot narrower in width than the diameter of said eyelet and wider in width than the diameter of said corresponding wire member, wherein said eyelet is inserted through the cross arm of the T-shaped slot and is pushed back beneath the edges forming the leg of the T-shaped slot and retained thereunder.

8. A plant or flower container of the type suspended from a suspension means having at least three downwardly and outwardly extending connector members with protuberances having increased diameters formed at the free ends of said connector members said container comprising:

(a) a molded plastic pot having an annular inverted U-shaped rim surrounding the upper edge thereof:

(b) said annular rim comprising an outer side wall, a top wall, and an inner side wall formed by the upper portion of the side wall of said pot;

(c) a plurality of slots spaced around the upper periphery of said rim for receiving said connector members therethrough;

(d) said slots being substantially T-shaped and having a generally circumferentially extending cross arm greater in dimension than the diameter of said corresponding protuberance and a generally radially extending leg formed by edges defining a slot narrower in width than the diameter of said protuberance and wider in width than the diameter of said corresponding connector arm, whereby said protuberance may be inserted through the cross arm of the T-slot and pushed back into and held between the edges forming the leg of the T-slot and retained thereunder;

(e) a reinforcing member positioned beneath said rim and said annular recess at a point underlying each of said T-shaped slots, said reinforcing member comprising a boss having side and rear walls depending from said rim and an open bottom, said side and rear walls and open bottom forming a cavity in said boss defined by said side walls, said rear wall, and the adjacent wall of said container, the leg of said T-shaped slot extending through said rear wall as well as through said rim, whereby said protuberance is inserted through said cross arm and the wire is then moved radially inwardly through said leg portion, whereupon said protuberance is lifted into seated arrangement in said cavity; and (f) said cavity further including a bead projecting from the adjacent wall of said container into said cavity engaging said protuberance when said protuberance is seated in said boss.

9. The container according to claim 8 wherein the size and shape of said cavity are substantially the same as the corresponding size and shape of the protuberance whereby a friction fit of said protuberance in said cavity is effected.

* * * * *